US006019625A

United States Patent [19]

Nimura et al.

[11] Patent Number: 6,019,625

[45] Date of Patent: Feb. 1, 2000

[54] RETRACTABLE ELECTRICAL CONNECTOR STRUCTURE AND METHOD FOR ASSEMBLING AND CONNECTING A RETRACTABLE ELECTRICAL CONNECTOR STRUCTURE

[75] Inventors: Kazuhiko Nimura; Kozue Takatsuki, both of Yokkaichi, Japan

[73] Assignee: Sumitomo Denso Inc., Mie, Japan

[21] Appl. No.: 09/143,511

[22] Filed: Aug. 28, 1998

[51] Int. Cl.[7] ..... H01R 13/15

[52] U.S. Cl. ..... 439/259; 439/77

[58] Field of Search ..... 439/259, 260, 439/67, 77

[56] References Cited

U.S. PATENT DOCUMENTS

| | | | |
|---|---|---|---|
| 5,051,100 | 9/1991 | Kato et al. . | |
| 5,230,636 | 7/1993 | Masuda et al. . | |
| 5,286,225 | 2/1994 | Tsuji . | |
| 5,306,158 | 4/1994 | Endo et al. . | |
| 5,411,406 | 5/1995 | Kondo | 439/259 |
| 5,489,216 | 2/1996 | Matsushita et al. | 439/260 |
| 5,573,415 | 11/1996 | Fujitani et al. | 439/260 |
| 5,575,061 | 11/1996 | Tsuji et al. . | |
| 5,632,638 | 5/1997 | Matsushi et al. | 439/260 |
| 5,915,986 | 6/1999 | Maejima | 439/259 |

FOREIGN PATENT DOCUMENTS

Y2-2-24222 7/1990 Japan .

*Primary Examiner*—Michael L. Gellner
*Assistant Examiner*—Antoine Ngandjui
*Attorney, Agent, or Firm*—Oliff & Berridge, PLC

[57] ABSTRACT

An electrical connector structure comprises a first electrical component including a first block accommodating at least one first electrical terminal, a second block accommodating at least one second electrical terminal, and a housing that receives the first and second blocks. The housing has an end wall including upper and lower walls including, respectively, first and second opening portions aligned with the first and second electrical terminals. The first and second blocks are movable within the housing between a retracted position in which contact pieces of the first and second electrical terminals are retracted and protected from damage within the housing and an extended position in which the contact pieces of the first and second terminals extend through the first and second opening portions of the housing for connection to an electrical component, e.g., an FPC and/or a bus bar, of a second electrical connector component. The second electrical component includes a recess that receives the first electrical connector component and an electrical contact element on a wall of the recess and electrically connectable with the contact pieces of the first and second terminals. Block separating structure (e.g., a projection arm and/or a pin and groove arrangement) forces the first and second blocks from their retracted position into the extended position for electrically connecting the contact pieces with the electrical contact element when the first and second connector components are connected.

24 Claims, 6 Drawing Sheets

RETRACTABLE ELECTRICAL CONNECTOR STRUCTURE AND METHOD FOR ASSEMBLING AND CONNECTING A RETRACTABLE ELECTRICAL CONNECTOR STRUCTURE

BACKGROUND OF THE INVENTION

1. Field of Invention

The present invention relates to a connector structure which is used in conjunction with a flexible printed circuit (FPC) and/or a bus bar. In particular, the present invention relates to a connector structure in which contact pieces of terminals within a first connector component are protected and connected to a second connector component holding the FPC and/or bus bar without exposing the contact pieces of the terminals to damage before connecting the first and second connector components. Once connected, the contact pieces of the terminals are exposed for connection to the FPC and/or bus bar. The present invention also relates to a method for assembling and connecting first and second electrical connector components in which contact pieces of terminals are protected in a retracted position and pressure-welded or insulation displacement type terminals can be inserted into the first connector component before connecting the wires to the terminals.

2. Description of Related Art

An FPC connector is shown in U.S. Pat. No. 5,230,636 to Masuda et al. The connector for an FPC 45 generally comprises of a female connector 26 and a terminal protection type connector 35, shown in FIG. 7. Because the connector 35 includes externally exposed elastic contacts 40, it is possible that the elastic contacts 40 can be damaged or deformed by contacting a foreign object or the like before connecting with the FPC 45. Therefore, as shown in FIG. 3, a terminal protecting member 5 is provided on the outer periphery of a housing 2 for protecting elastic contacts 24. As shown in FIGS. 4 and 5, the terminal protective member 5 slides to expose the elastic contacts 24 as the connector is inserted into an opening 26. As a result, the elastic contacts 24 and a terminal 31 a can be electrically connected with one another.

U.S. Pat. No. 5,575,061 discloses an insulation displacement-type terminal in which wires 40 are pressure-welded into terminals 38 within a housing. However, only single level connectors are possible with this arrangement, although all wires can be inserted simultaneously into the respective terminals.

Japanese Patent Laid-Open No. 2-24222 discloses a two level connector structure in which elastic contacts 7*b* are provided at both left and right surfaces of a common housing 6. The terminals 7 are held in place within the housing 6 using flexible lances 8. The elastic contacts 7*b* are retracted into the housing 6 before the connector 5 is connected to the second connector 2. The elastic contacts 7*b* are pushed forward via the lance 8 by a projection 10 which is provided on the connector 2. As a result, the elastic contacts 7*b* contact an FPC 3. Only one terminal at a time can be crimped and/or inserted into the housing.

However, U.S. Pat. Nos. 5,230,636 and 5,575,061 only provide for one level terminals, while the connector structure of Japanese publication 2-24222 requires connection of the wires 11 to the terminals 7 before the terminals are inserted into the housing 6. Moreover, Japanese publication 2-24222 uses crimp type terminals in which the ends of wires 11 are stripped and are crimped on a wire barrel of the terminal 7 while an insulation barrel is crimped to the insulation part of the wires 11. Due to the limited access of the terminals within the housing, it is not possible to connect or crimp the wires onto the terminals after the terminals are inserted into the housing. Moreover, crimping of the exposed portion of the wire 11 requires a force that would cause damage to the connector component or housing if the wires are assembled to the terminals while the terminals are in the housing.

SUMMARY OF THE INVENTION

The present invention has one object to avoid the above noted shortcomings of the prior art.

Another object of the invention is to provide an electrical connector structure in which a housing includes two separate inner blocks, each of which stores a terminal, that protect elastic contact pieces of terminals that can project out of top and bottom surfaces of the housing.

A further object of the invention is to provide a structure and method in which retractable contact pieces of a first connector component are protected prior to contacting an FPC and/or bus bar of a second connector component at the time of connecting and/or disconnecting the connector components.

Another object of the invention is to provide pressure-welding type terminals which are connected with electric wires by pushing the electric wires into pressure-welding slots of the terminals, after the terminals are prestored or inserted into terminal insertion chambers of first and second separate blocks within a housing. A two-level connector can be obtained by assembling the upper and lower blocks in opposed relation such that contact pieces of the first and second or upper and lower electric terminals can reciprocate between retracted and extended positions.

According to another object or a first embodiment of the present invention, an electrical connector structure comprises a first electrical component including a first block accommodating at least one first electrical terminal, a second block accommodating at least one second electrical terminal, and a housing that receives the first and second blocks, the housing having an end wall and upper and lower walls including, respectively, first and second opening portions aligned with the first and second electrical terminals, the first and second blocks being movable within the housing between a retracted position in which contact pieces of the first and second electrical terminals are retracted within the housing and an extended position in which the contact pieces of the first and second terminals extend through the first and second opening portions of the housing.

The electrical connector structure may also include a second electrical connector component including a recess that receives the first electrical connector component, an electrical contact element on a wall of the recess and electrically connectable with the contact pieces of the first and second terminals, and block separating structure that forces the first and second blocks from their retracted position into the extended position for electrically connecting the contact pieces with the electrical contact element. The block separating structure may comprise: 1) a projection arm received within an opening of the first electrical connector component; and/or 2) grooves that receive pins on the first electrical connector component.

In embodiments, the housing includes a side wall at each end of the end wall and each side wall includes a groove that receives at least a first pin on the first block and a second pin on the second block. Each groove may include a pair of projections that resiliently hold the first and second pins in an inner position before the first and second electrical connector components are connected, the first and second pins moving from the inner position, past the projections, to an outer position when the first and second electrical connector components are connected. In embodiments, the first and second electrical terminals may comprise insulation displacement type terminals.

According to another aspect of the invention, a method is provided for assembling and connecting first and second electrical connector components. The method includes inserting at least a first insulation type terminal into a first block and a second insulation type terminal into a second block, pressure-welding a first wire into the first terminal and a second wire into the second terminal after the first and second terminals are inserted into the first and second blocks, inserting the first and second blocks into a housing to form the first electrical connector component, the housing including first and second opening portions aligned with the first and second terminals, the first and second blocks being resiliently maintained in a retracted position within the housing, and connecting the first and second connector components such that block separating structure of the second connector component moves the first and second blocks from the retracted position to an extended position in which contact pieces of the first and second electrical terminals extend through the first and second opening portions to electrically contact an electrical contact element of the second connector component.

These and other objects and/or aspects of the present invention will be described in and/or apparent from the following detailed description of preferred embodiments.

BRIEF DESCRIPTION OF THE DRAWINGS

Preferred embodiments of the invention will be described in conjunction with the attached drawings, in which.

DETAILED DESCRIPTION OF PREFERRED EMBODIMENTS

Figure 1:
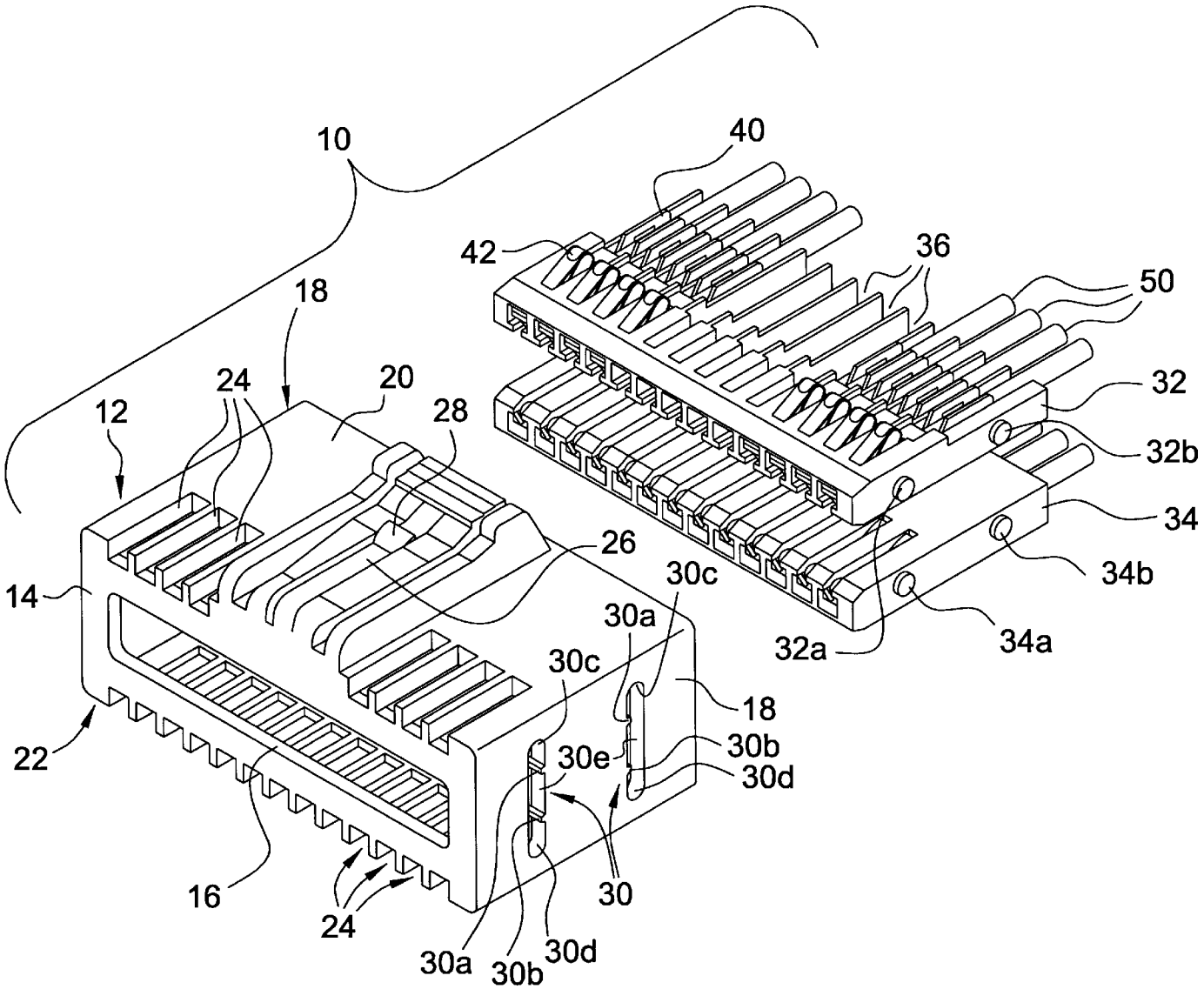
FIG. 1 shows an exploded perspective view of a first connector component according to a first embodiment of the present invention.
Figure 2:
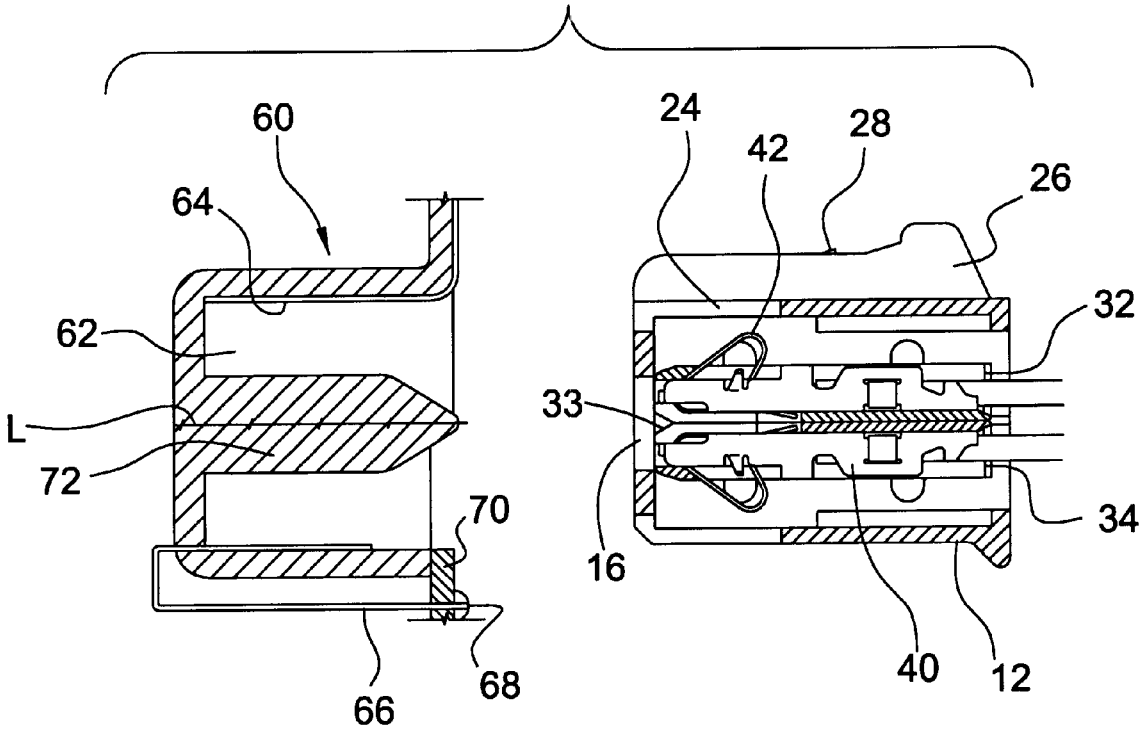
FIG. 2 illustrates the first and a second connector component prior to assembly while terminals are in a retracted state according to the first embodiment of the present invention.
Figure 3:
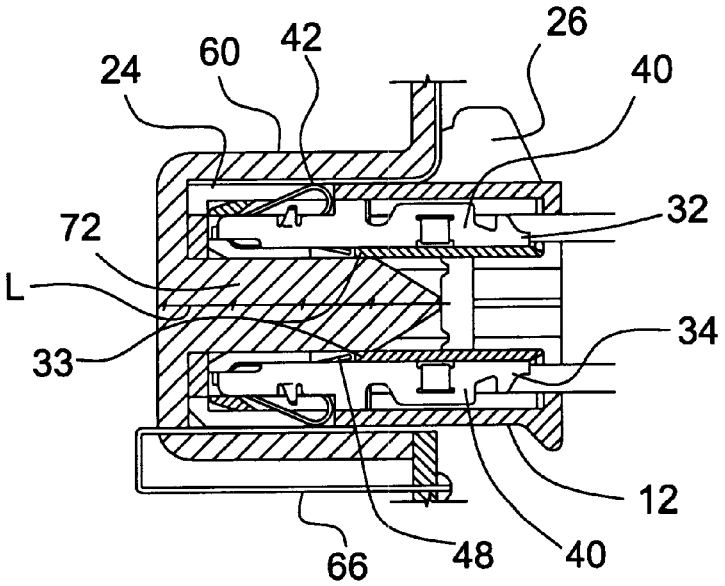
FIG. 3 illustrates the first and second connector components in the fully connected state according to the first embodiment of the present invention.
Figure 7:
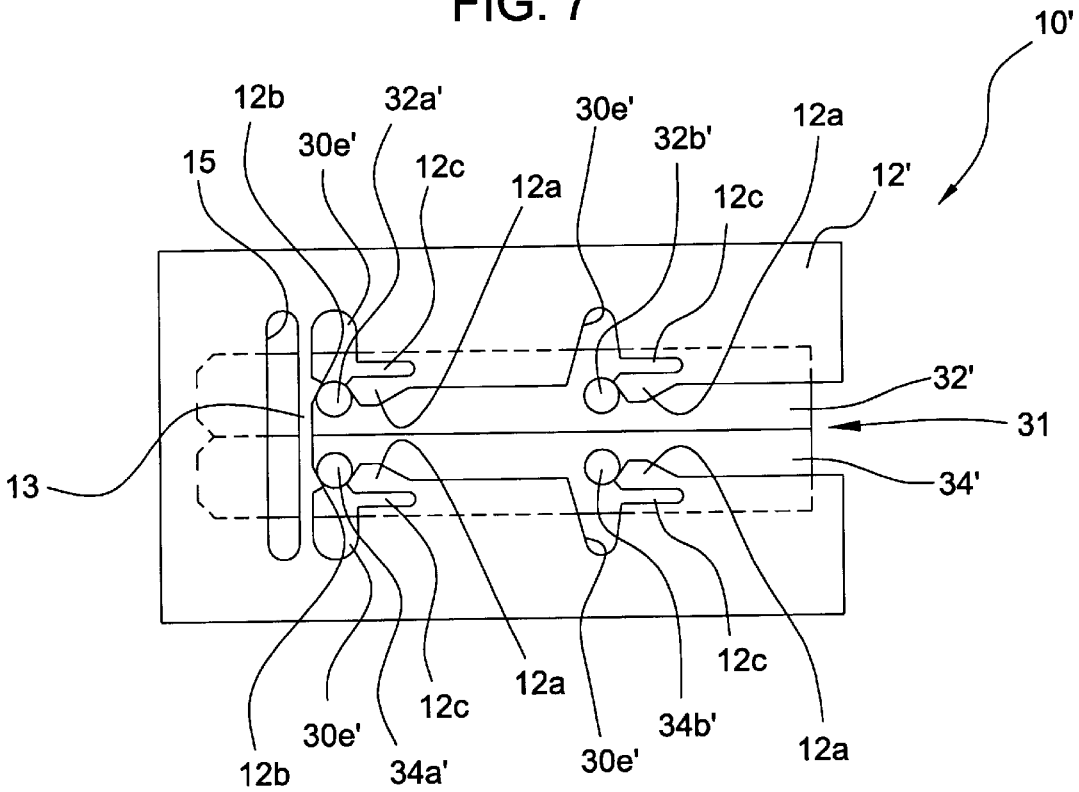
FIG. 7 illustrates an enlarged, schematic side view of the first connector component in the retracted position according to the second embodiment of the present invention.
Figure 8:
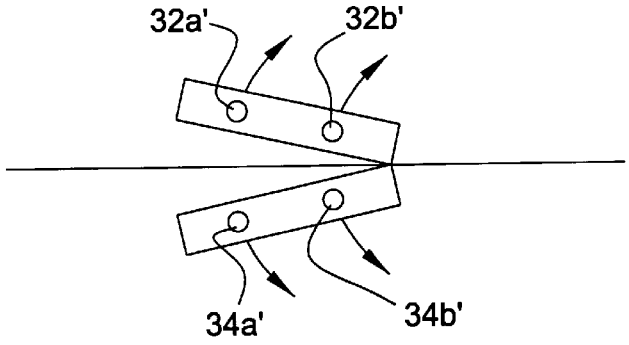
FIG. 8 illustrates a schematic view of first and second blocks of the first connector component according to the first or second embodiment of the present invention.
Figure 9:
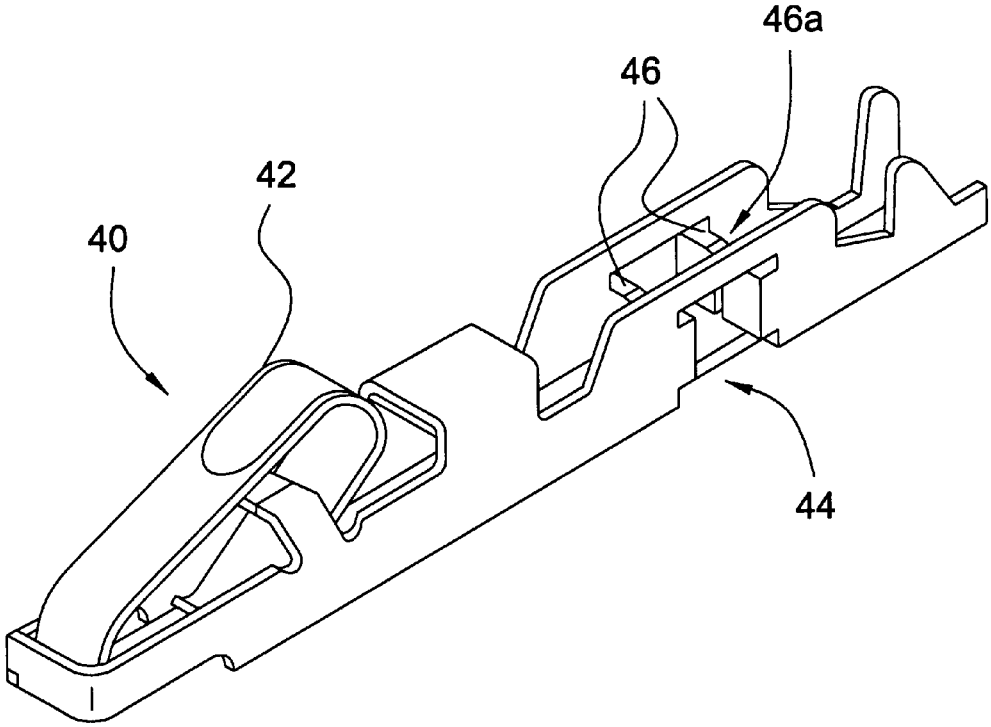
FIG. 9 illustrates a perspective view of an insulation displacement type terminal.
Figure 10:
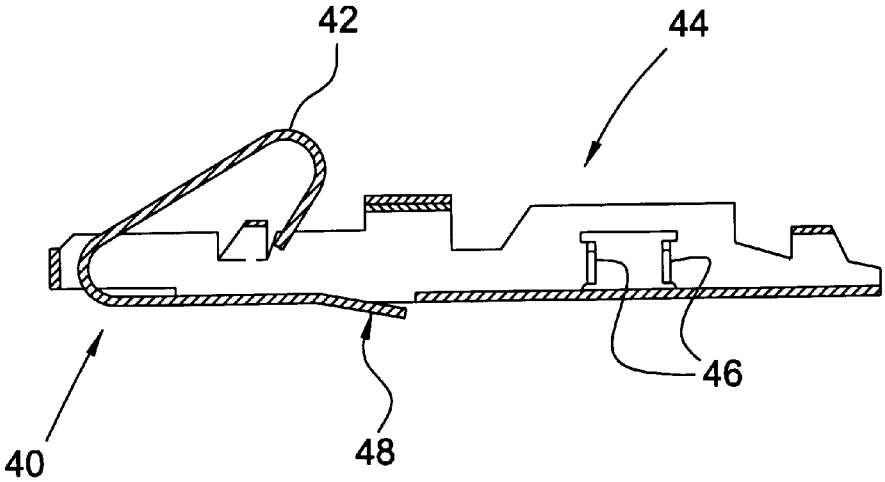
FIG. 10 illustrates a side view of the insulation displacement type terminal shown in FIG. 9.

Preferred embodiments of the present invention will be described with reference to FIGS. 1–10 in which FIGS. 1–3 illustrate a first embodiment of the present invention, FIGS. 4–8 illustrate a second embodiment of the present invention, and FIGS. 9 and 10 illustrate an insulation displacement type terminal for use in the first and second embodiments of the present invention.

FIG. 1 shows an exploded view of a first connector component 10 according to a first embodiment of the present invention. The first connector component is shown as being made, for example, of a plastic or other suitable material. The first connector component 10 includes a housing 12 including an end wall 14 defining an opening 16, side walls 18 on each side of the end wall 14, and top and bottom walls 20, 22, each of which includes at least one opening portion 24. The top wall 20 of the housing 12 also includes a locking arm 26 which includes a first lock element 28, described later. Each side wall 18 of the housing includes at least one groove 30, and each groove 30 can include at least first and second projections 30*a* and 30*b*, the functions of which are described below.

The first connector component 10 also includes an upper or first block 32 and a lower or second block 34. Each of the first and second blocks 32, 34 includes at least one terminal insertion chamber 36 into which electrically conductive terminals or terminal members 40 having wires 50 are inserted. As shown in FIG. 1, the terminal receiving chambers 36 in the center of the first block 32 are not occupied by terminals because those terminals would align with and be formed below the locking arm 26 of the housing 12. Of course, the lower set of terminal receiving chambers in the second block 34 could include the same amount of terminals as shown in the first block 32, or all of the terminal receiving chambers 36 in the second or lower block 34 could be occupied by terminals 40.

Enlarged views of the terminals 40 are shown in FIGS. 9 and 10. The terminals 40 are, for example, insulation displacement type terminals made, for example, of metal or another electrical conductor. However, other types of terminals are contemplated for use with the present invention. As shown in FIG. 9, each terminal 40 includes a contact piece 40 that extends away from the first and second blocks 32 and 34. In FIGS. 9 and 10, the wires 50 have not yet been assembled with the terminals 40. Each terminal 40 includes a pressure welding slot 46*a* having a blade section 44 including at least one blade member 46. Upon inserting an insulated wire into contact with the blade members 46, the wire 50 is tightly clamped between opposed ones of each of the blade members 46. At the same time, the blade members 46 will cut through the insulation to establish full electrical contact with the metallic portion of the wires 50. This procedure is referred to as pressure-welding. It is well known from U.S. Pat. No. 5,575,061 to Tsuji et al. As disclosed in at least FIGS. 5 and 6 of Tsuji, the pressure-welding procedure can be performed while the terminal members are contained within a housing due to low pressure or force requirements, which will not damage the housing. Obviously, the wires 50 can be pressure-welded before the terminals 40 are inserted into the first and second blocks. However, crimp type terminals do not allow crimping of the wires while the terminals are in the housing because the relative high amount of force would cause damage to the housing.

Referring back to FIG. 1, once the terminals 40 are inserted into the first and second blocks 32 and 34, and the wires 50 are pressure-welded into the terminals 40, the blocks 32 and 34 are inserted into the housing 12. Terminals 40 include lances 48 (FIG. 3) that lock the terminals 40 to walls 33 of the first and second blocks 32 and 34.

The first block 32 includes a first pin 32*a* or a side wall thereof The second block 34 includes a second pin 34*a* opposed to the first pin 32*a*. The first block 32 also includes a third pin 32*b* which is aligned with a fourth pin 34*b* of the second block 34. Upon insertion of the first and second blocks 32 and 34 into the housing 12, the first and second pins 32*a* and 34*a* align with and are inserted into the groove 30 closest to the end wall 14 of the housing 12. Optionally, guide passages (not shown) can be formed on an inner surface of the side walls 18 to guide the pins 32*a* and 34*a* to facilitate insertion of the first and second blocks 32 and 34 into the housing 12. The third and fourth pins 32*b* and 34*b* are similarly received in the other groove 30 furthest away from the end wall 14. The pins 32*a* and 34*a* are provisionally maintained in an inner position 30*e* of the groove 30 between the resilient projections 30*a* and 30*b*. Similarly, the third and fourth pins 32*b* and 34*b* are maintained in an inner position 30*e* of the groove 30 furthest from the end wall 14 between the projections 30*a* and 30*b*. In this position, the first connector component 10 is resiliently maintained in the retracted position in which the first and second blocks 32 and 34 hold the contact pieces 42 of the terminals 40 in a retracted and protected state within the housing 12. See FIG. 2.

Although the first and second blocks 32 and 34 are shown as including third and fourth pins 32*b* and 34*b*, respectively, the third and fourth pins 32*b* and 34*b* need not be formed as pins but can instead be guide elements that slide freely within the groove 30 furthest away from the end wall 14. Moreover, it is not necessary to provide projections 30*a* and 30*b* in the groove 30 furthest from the end wall 14.

FIG. 2 also shows a second connector component 60 which defines a recess 62 for receiving the first connector component 10. The recess 62 at upper and lower walls thereof includes at least one electrical contact element which is intended to electrically connect with the terminals 40 of the first and second blocks 32 and 34. For example, an upper surface of the recess 62 may include a flexible printed circuit (FPC) 64 and a lower surface of the recess 62 may include a bus bar 66. The bus bar 66 may include a soldering point 68 for securing the bus bar 66 to a wall 70 of the second connector 60.

Typically, the recess 62 will be provided with similar electrical contact elements, such as two bus bars or two FPC's. However, for purposes of illustration, the second connector component 60 shows both the FPC and the bus bar. A dividing line L along the projection arm 72 is intended to illustrate that the FPC and bus bar are not typically combined in the illustrated fashion. Of course, both the upper and lower surfaces of the recess 62 can be associated with FPCs, bus bars or the like.

The second connector component 60 also includes block separating structure, e.g., a projection arm 72, that cooperates with the opening 16 in the first connector component 10. Upon insertion of the projection arm 72 in the opening 16 and between the first and second connector components 10 and 60, a tapered end of the projection arm 72 is received between the first and second blocks 32 and 34. The first and second blocks may form an arrow shaped recess 33 for receiving a tip of the projection arm 72.

FIG. 3 shows a fully connected position between the first and second connector components 10 and 60. In this position, the projection arm 72 has urged the first and second blocks 32 and 34 in opposite directions such that the contact piece 42 of the upper terminal 40 connects with the flexible printed circuit 64, and the contact piece 42 of the lower terminal 40 contacts the bus bar 66. The contact pieces 42 of each of the upper and lower terminals 40 extend through openings 24 in the top and bottom walls 20 and 22 of the housing 12. Furthermore, the lock element 28 of the locking arm 26 engages with a similarly shaped lock receiving element (not shown) formed in the recess 62 of the second connector component 60.

During insertion of the projection arm 72 of the second connector component 60 into the opening 16 of the first connector component, the first and second pins 32*a* and 34*a* are urged from the inner position 30*e* of the groove 30 closest to the end wall 14 past the projections 30*a* and 30*b* and into the outer positions 30*c* and 30*d* of the groove 30. Assuming the pins 32*b* and 34*b* are provided on the first and second blocks 32 and 34, the pins 32*b* and 34*b* occupy the outer positions 30*c*, 30*d* of the groove 30 furthest from the end wall 14.

If the first and second connector components 10 and 60 are disconnected from the position shown in FIG. 3 such that the first and second connector components separate from one another, the first and second blocks 32 and 34 remain in the extended position in which the contact pieces 42 of the terminals 40 may be exposed to and unprotected from damage.

Figure 4:
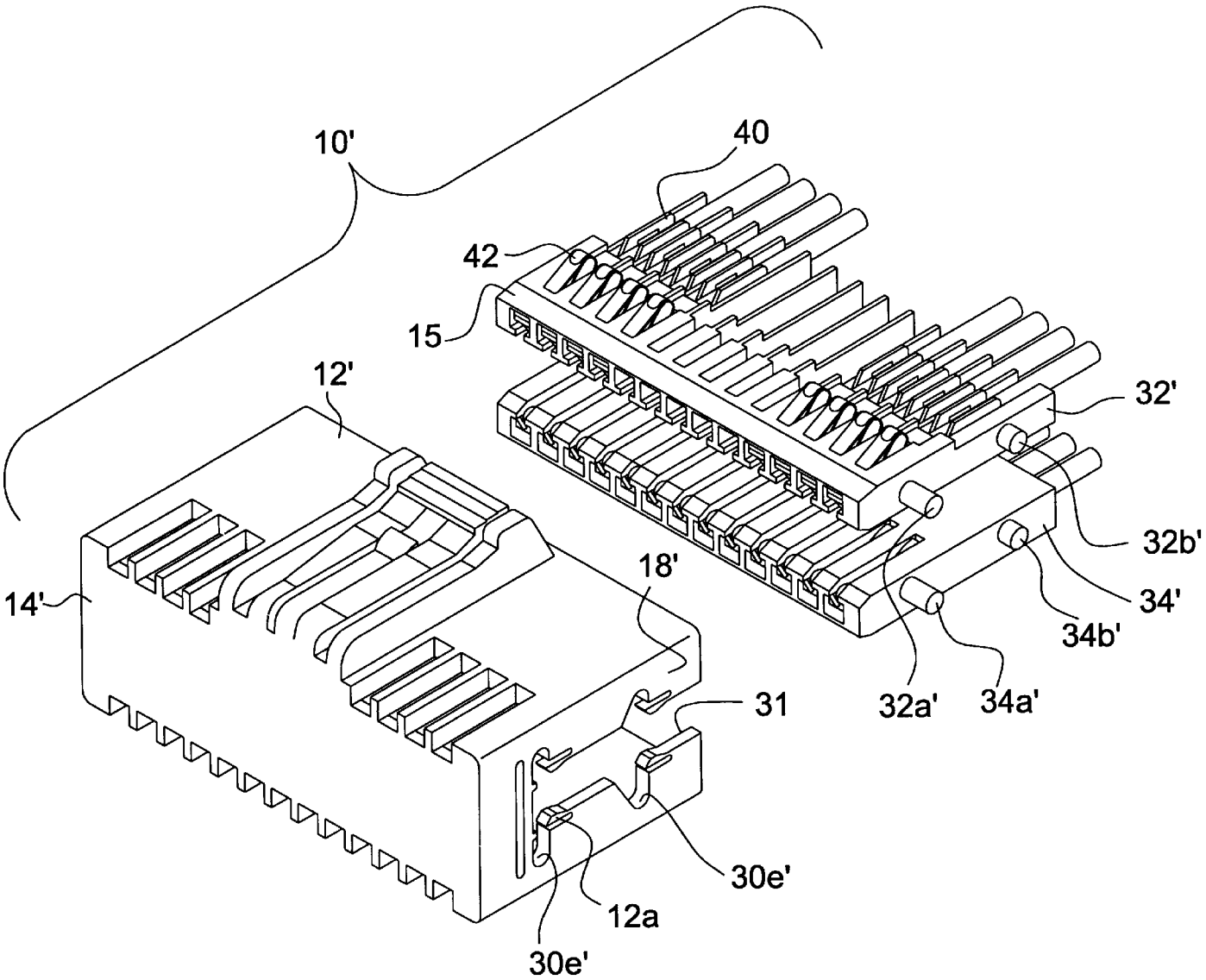
FIG. 4 illustrates an exploded perspective view of a first connector component according to a second embodiment of the present invention.
Figure 5:
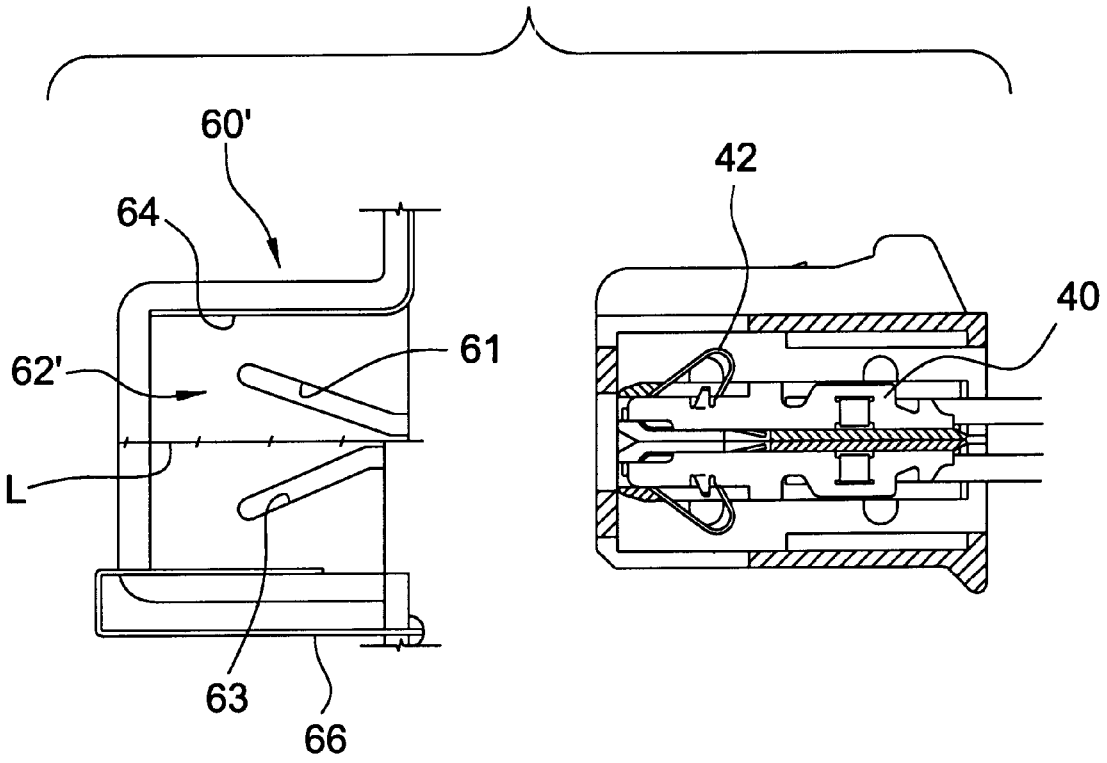
FIG. 5 illustrates the first and a second connector component in an unassembled state while terminals are in the retracted position according to the second embodiment of the present invention.
Figure 6:
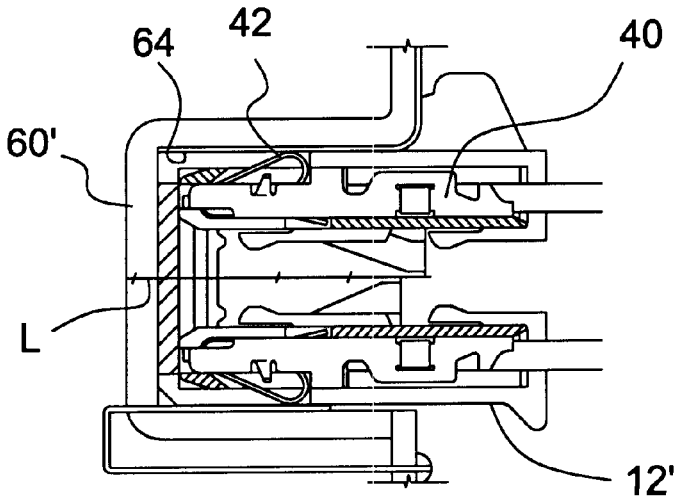
FIG. 6 illustrates the first and second connector components in the connected state according to the second embodiment of the present invention.

The second embodiment shown in FIGS. 4–6 provides a solution to this problem. The first connector component 10' is similar to that shown in FIG. 1 of the first embodiment. However, the housing 12' shown in FIG. 4 includes modified sidewalls 18' compared to the housing 12 of the first embodiment. For example, the end wall 14' does not require an opening, and a guide passage 31 is provided to facilitate insertion of first and second blocks 32' and 34' into the housing 12'. Once inserted, the first and second blocks 32' and 34' assume the position shown in FIG. 5 in which the contact pieces 42 of the terminals 40 are maintained in the retracted position.

FIG. 7 shows an enlarged, schematic side view of the first connector component 10'. The housing 12' includes, for example, four projections 12*a* in the form of beam shaped stopper arms having multiple functions. For example, each of the beam shaped stopper arms 12*a* is resiliently flexed into an arm flexing space 12*c* as pins 32*a*', 32*b*', 34*a*' and 34*b*' are inserted into the guide passage 31 of the housing 12'. Upon full insertion, the beam shaped stopper arms 12*a* flex away from the flexing spaces 12*c* to resiliently lock the pins in position to prevent longitudinal movement of the first and second blocks 32' and 34' along the guide passage 31 and outside the housing 12'.

Upon obtaining the position shown in FIG. 7, the first connector component 10' is inserted in a connected state with the second connector component 60'. The second connector component 60' is similar to the second connector component 60 shown in the first embodiment, in that an FPC 64 is provided in an upper portion of the recess 62', and a bus bar 66 is provided along a lower surface of the recess 62'.

As discussed above in relation to FIG. 2, a dividing line L shows that the FPC and bus bar are not typically combined in the illustrated fashion. Moreover, both the upper and lower surfaces of the recess 62' can be associated with FPC's, bus bars or the like.

However, the second connector component 60' does not require a projection arm 72, as is present in the first embodiment, but rather includes a pair of guide grooves 61 and 63 that serve as block separating structure. The guide groove 61 is intended to receive the first pin 32*a*' and the guide groove 63 is intended to receive the second pin 34*a*' when the first and second connector components 10' and 60' are connected with respect to one another. To facilitate engagement, the pins 32*a*' and 34*a*' can be made longer than the pins 32*b*' and 34*b*'.

Upon engagement, guidance of the pins 32*a*' and 34*a*' in the guide grooves 61 and 63 moves the first and second blocks 32' and 34' in opposite directions until the contact pieces 42 of the terminals 40 engage with the FPC 64 and the bus bar 66 of the recess 62'. In this sense, the second embodiment is similar to the first embodiment. However, upon disconnection of the first and second connector components from the position shown in FIG. 6 to where the first and second connector components are separated from one another (FIG. 5), the first and second blocks 32' and 34' and accompanying contact pieces 42 of the terminals 40 return to the retracted position because the guide grooves 61 and 63 guide the pins 32*a*' and 34*a*' until the first and second blocks 32' and 34' again assume the position shown in FIGS. 5 and 7 between the beam shaped stopper arms 12*a* and opposed projections 12*b*. However, the guidepins 32*b*' and 34*b*' do not necessarily have to engage with the guide grooves 61 and 63, e.g., the first and second blocks 32' and 34' can simply rotate about the pins 32*b*' and 34*b*'. However, separation or sliding movement of the pins 32*b*' and 34*b*' is not necessary since the contact pieces 42 of the terminals 40 are located in alignment with the first and second pins 32*a*' and 34*a*' such that movement of the contact pieces 42 is more directly controlled by the pins 32*a*' and 34*a*' rather than the pins 32*b*' and 34*b*'. This situation is schematically illustrated in FIG. 8.

Furthermore, when moving from the position shown in FIG. 5 or 7 to that shown in FIG. 6, at least the guide pins 32*a*' and 34*a*' are forced into engagement with beam shaped stopper arms 12*a* and the opposed projections 12*b*. Upon connection, the pins 32*a*' and 34*a*' are guided along the guide grooves 61 and 63, and the beam shaped stopper arms 12*a* are forced into the flexing space 12*c* while the projections 12*b* cause a partitioning wall 13 to flex into a partition wall flexing space 15 provided opposite the projections 12*b*. Once the pins 32*a*' and 34*a*' pass between elements 12*a* and 12*b*, elements 12*a* and 12*b* flex back into their normal unflexed positions. Upon disconnection of the first and second connector components 10' and 60', the first and second pins 32*a*' and 34*a*' move back from the outside position 30*e*' of the groove to the inside position of the groove shown in FIG. 7. During the return movement, the pins 32*a*' and 34*a*' contact the projections 12*b* to cause the partition wall 13 to flex into the partition wall flexing space 15 until the pins pass. In this manner, even if the first and second connector components are connected and then disconnected, the contact pieces 42 of the terminals 40 are maintained in the protected state and in the retracted position within the housing 12'.

While the present invention has been described with reference to what are presently considered to be preferred embodiments thereof, it is understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment or element, are also within the spirit and scope of the invention.

What is claimed is:

1. An electrical connector structure comprising:

a first electrical connector component including:

a first block accommodating at least one first electrical terminal, a second block accommodating at least one second electrical terminal, and a housing that receives the first and second blocks, the housing having an end wall and upper and lower walls including, respectively, first and second opening portions aligned with the first and second electrical terminals, the first and second blocks being movable within the housing between a retracted position in which contact pieces of the first and second electrical terminals are retracted within the housing and an extended position in which the contact pieces of the first and second terminals extend through the first and second opening portions of the housing; and a second electrical connector component including:

a recess that receives the first electrical connector component, an electrical contact element on a wall of the recess and electrically connectable with the contact pieces of the first and second terminals, and block separating structure that forces the first and second blocks from the retracted position into the extended position for electrically connecting the contact pieces with the electrical contact element.

2. The electrical connection structure according to claim 1, wherein the housing of the first electrical connector component has an opening in the end wall, and the block separating structure includes a projection arm that forces the first and second blocks to the extended position when the projection arm enters the opening during connection of the first and second connector components.

3. The electrical connection structure according to claim 1, further comprising a resilient locking arm connected to the housing, the locking arm including a first lock element that engages with a second lock element on the second electrical connector component.

4. The electrical connection structure according to claim 1, wherein the first and second electrical terminals comprise insulation displacement type terminals.

5. The electrical connection structure according to claim 1, wherein the housing includes a side wall at each end of the end wall, each side wall including a groove that receives at least a first pin on the first block and a second pin on the second block.

6. The electrical connection structure according to claim 5, wherein each groove includes a pair of projections that provisionally hold the first and second pins in an inner position of the groove to maintain the first and second blocks in the retracted position before the first and second electrical connector components are connected, the first and second pins moving from the inner position to an outer position of the groove when the first and second electrical connector components are connected.

7. The electrical connection structure according to claim 6, wherein the projections comprise beam shaped stopper arms that prevent disengagement between the housing and the first and second blocks.

8. The electrical connection structure according to claim 6, wherein the block separating structure includes a first guide groove that guides the first pin and a second guide groove that guides the second pin, wherein the first and second blocks are moved to the extended position when the first and second electrical connector components are connected, and the first and second blocks are moved to the retracted position when the first and second electrical connector components are disconnected.

9. The electrical connection structure according to claim 5, wherein each side wall includes a flexing space and a partition wall adjacent each groove, the partition wall flexing into the flexing space when the first and second blocks are moved to the extended position.

10. The electrical connection structure according to claim 9, wherein each side wall includes a guide passage that guides the first and second pins to first and second projections that resiliently and selectively maintain the first and second blocks in the extended and retracted positions.

11. The electrical connection structure according to claim 10, wherein the projections comprise beam shaped stopper arms that prevent longitudinal movement of the first and second blocks along the guide passage of the housing.

12. The electrical connection structure according to claim 5, further comprising a third pin mounted on the first block and a fourth pin mounted on the second block, the third and fourth pins being coupled to additional grooves in the housing.

13. The electrical connection structure according to claim 12, wherein the first and second pins are aligned with the contact pieces of the first and second electrical terminals, and the first and second pins are longer than the third and fourth pins.

14. An electrical connector component comprising:

a first block accommodating at least one first electrical terminal;, a second block accommodating at least one second electrical terminal; and a housing that receives the first and second blocks, the housing having an end wall and upper and lower walls including, respectively, first and second opening portions aligned with the first and second electrical terminals, the first and second blocks being movable within the housing between a retracted position in which contact pieces of the first and second electrical terminals are retracted within the housing and an extended position in which the contact pieces of the first and second terminals extend through the first and second opening portions of the housing.

15. The electrical connector component according to claim 14, wherein the housing includes an opening located in the end wall that is adapted to receive a projection arm that forces the first and second blocks into the extended position.

16. The electrical connector component according to claim 14, further comprising a resilient locking arm connected to the housing, the locking arm including a first lock element that engages with a second lock element on a second connector component.

17. The electrical connector component according to claim 14, wherein the first and second electrical terminals comprise insulation displacement type terminals.

18. The electrical connector component according to claim 14, wherein the housing includes a side wall at each end of the end wall, each side wall including a groove that receives at least a first pin on the first block and a second pin on the second block.

19. The electrical connector component according to claim 18, wherein each groove includes a pair of projections that provisionally hold the first and second pins in an inner position to maintain the first and second blocks in the retracted position, the first and second pins moving from the inner position to an outer position when the first and second blocks are moved to the extended position.

20. The electrical connector component according to claim 19, wherein the projections comprise beam shaped stopper arms that prevent disengagement between the housing and the first and second blocks.

21. The electrical connector component according to claim 18, wherein each side wall includes a flexing space and a partition wall adjacent each groove, the partition wall flexing into the flexing space when the first and second blocks are moved from the retracted position.

22. The electrical connector component according to claim 21, wherein each side wall includes a guide passage that guides the first and second pins to first and second projections that resiliently and selectively maintain the first and second blocks in the extended and retracted positions.

23. The electrical connector component according to claim 22, wherein the projections comprise beam shaped stopper arms that prevent longitudinal movement of the first and second blocks along the guide passage of the housing.

24. A method for assembling and connecting first and second electrical connector components, comprising:

inserting at least a first insulation type terminal into a first block and a second insulation type terminal into a second block;

pressure-welding a first wire into the first terminal and a second wire into the second terminal after the first and second terminals are inserted into the first and second blocks;

inserting the first and second blocks into a housing to form the first electrical connector component, the housing including first and second opening portions aligned with the first and second terminals, the first and second blocks being resiliently maintained in a retracted position within the housing; and connecting the first and second connector components such that block separating structure of the second connector component moves the first and second blocks from the retracted position to an extended position in which contact pieces of the first and second electrical terminals extend through the first and second opening portions to electrically contact an electrical contact element of the second connector component.

* * * * *